US006130648A

United States Patent [19]

Rulf et al.

[11] Patent Number: 6,130,648

[45] Date of Patent: Oct. 10, 2000

[54] DOUBLE SLOT ARRAY ANTENNA

[75] Inventors: Benjamin Rulf, Springfield; Ming-Ju Tsai, Livingston, both of N.J.

[73] Assignee: Lucent Technologies Inc., Murray Hill, N.J.

[21] Appl. No.: 09/335,330

[22] Filed: Jun. 17, 1999

[51] Int. Cl.[7] ..... H01Q 13/10

[52] U.S. Cl. ..... 343/770; 343/767

[58] Field of Search ..... 343/767, 770, 343/771, 700 MS

[56] References Cited

U.S. PATENT DOCUMENTS

| | | | |
|---|---|---|---|
| 4,017,864 | 4/1977 | Proctor | 343/767 |
| 4,130,822 | 12/1978 | Conroy | 343/767 |
| 5,581,266 | 12/1996 | Peng et al. | 343/770 |

FOREIGN PATENT DOCUMENTS

| | | | |
|---|---|---|---|
| 2074792 | 11/1981 | United Kingdom | 343/767 |

*Primary Examiner*—Tan Ho

*Attorney, Agent, or Firm*—Christopher N. Malvone

[57] ABSTRACT

A slot antenna has an array of slot pairs where the E-plane beamwidth of the transmitted energy can be controlled. The antenna includes at least one pair of slots which are fed by a microstrip, and electric field barriers positioned between and parallel to the slots. The electric field barriers extend between the front and rear panels of the slot antenna. The distance between the electric field barriers is used to adjust or tune the antenna to a particular transmit or receive frequency, and the distance between the slots is used to control the E-plane beamwidth of the transmitted energy. When the slots are placed closer together, the beamwidth becomes wider, and when the slots are moved further apart, the beamwidth becomes narrower. In one embodiment, the electric field barrier is a series of closely spaced conductors, and in another embodiment, the electric field barrier is a conductive strip.

10 Claims, 4 Drawing Sheets

DOUBLE SLOT ARRAY ANTENNA

BACKGROUND OF THE INVENTION

1. Field of the Invention

The present invention relates to antennas; more particularly, slot antennas.

2. Description of the Prior Art

FIG. 1 illustrates prior art slot antenna 6. Slot antenna 6 includes front panel 10 and rear panel 12 separated by spacers 14. Rear panel 12 is typically made of a conductive material and front panel 10 contains an upper non-conductive layer 16 and a lower conductive layer 18. Microstrip 20 is deposited on the surface of layer 16 to provide a path for the signal to be transmitted or received. The ends of the microstrip extend across slots 22 in conductive layer 18. When a signal to be transmitted is provided on microstrip 20, electromagnetic energy is transmitted in the Z direction with an electric field polarized in the Y direction. Unfortunately, this arrangement provides no control over the beamwidth in the Y-Z plane.

FIG. 2 illustrates a prior art slot antenna having an array of slots; only the microstrip and slots are shown. This slot array antenna is fabricated using a design similar to the design illustrated in FIG. 1. In this configuration, microstrip 30 feeds the signal to be transmitted across slots 32. This results in electromagnetic energy being transmitted in the Z direction with an electric field polarization in the Y direction. In FIG. 2, the Z direction is the direction coming out of the figure toward the viewer. Once again, this design does not provide beamwidth control in the Y-Z plane.

SUMMARY OF THE INVENTION

The present invention provides a slot antenna having an array of slot pairs where the beamwidth of the transmitted energy can be controlled. The antenna includes at least one pair of slots which are fed by a microstrip, and electric field barriers positioned parallel to the slots. The electric field barriers extend between the front and rear panels of the slot antenna. The distance between the electric field barriers is used to adjust or tune the antenna to a particular transmit or receive frequency, and the distance between the slots is used to control the beamwidth of the transmitted energy. When the slots are placed closer together, the beamwidth becomes wider, and when the slots are moved further apart, the beamwidth becomes narrower. In one embodiment, the electric field barrier is a series of closely spaced conductors, and in another embodiment, the electric field barrier is a conductive strip.

DETAILED DESCRIPTION OF THE INVENTION

Figure 3:
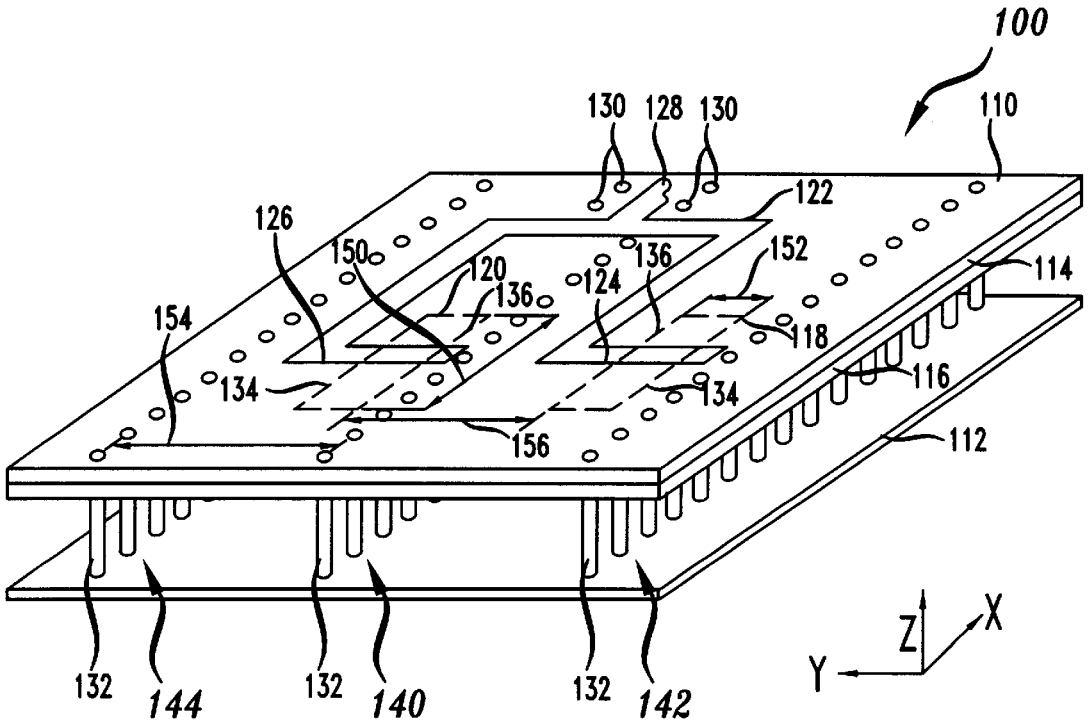
FIG. 3 illustrates a slot antenna having a pair of slots with electric field barriers between and parallel to the slots.

FIG. 3 illustrates slot antenna 100 which includes front panel 110 and rear panel 112. Front panel 110 includes non-conductive layer 114 and conductive layer 116. Slots 118 and 120 are openings in conductive layer 116. Microstrip 122 positioned on non-conductive layer 114 provides a signal path for signals provided to or received from slots 118 and 120. Microstrip section 124 extends over slot 118 and provides a signal path to slot 118. Microstrip section 126 extends over slot 120 and provides a signal path to slot 120. The signal to be transmitted (or received) is typically provided to (or received from) microstrip 122 at point 128 with ground connections being made at points 130. Points 130 are in electrical contact with conductive layer 116.

Conductive layer 116 is in electrical contact with rear panel 112 which is typically at ground potential. Electrical connection between conductive layer 116 and rear panel 112 is provided by conductors 132. Conductors 132 are arranged in a line substantially perpendicular to microstrip sections 124 or 126. Conductors 132 form an electric field barrier that is substantially parallel to long slot edges such as outside edge 134 and inner edge 136. The electric field barrier extends between conductive layer 116 and rear panel 112. Electric field barrier 140, which is formed using conductors 132, is positioned between slots 118 and 120. Electric field barriers 142 and 144, which are also formed using conductors 132, are positioned outside outer edge 134 of slots 118 and 120, respectively.

Figure 1:
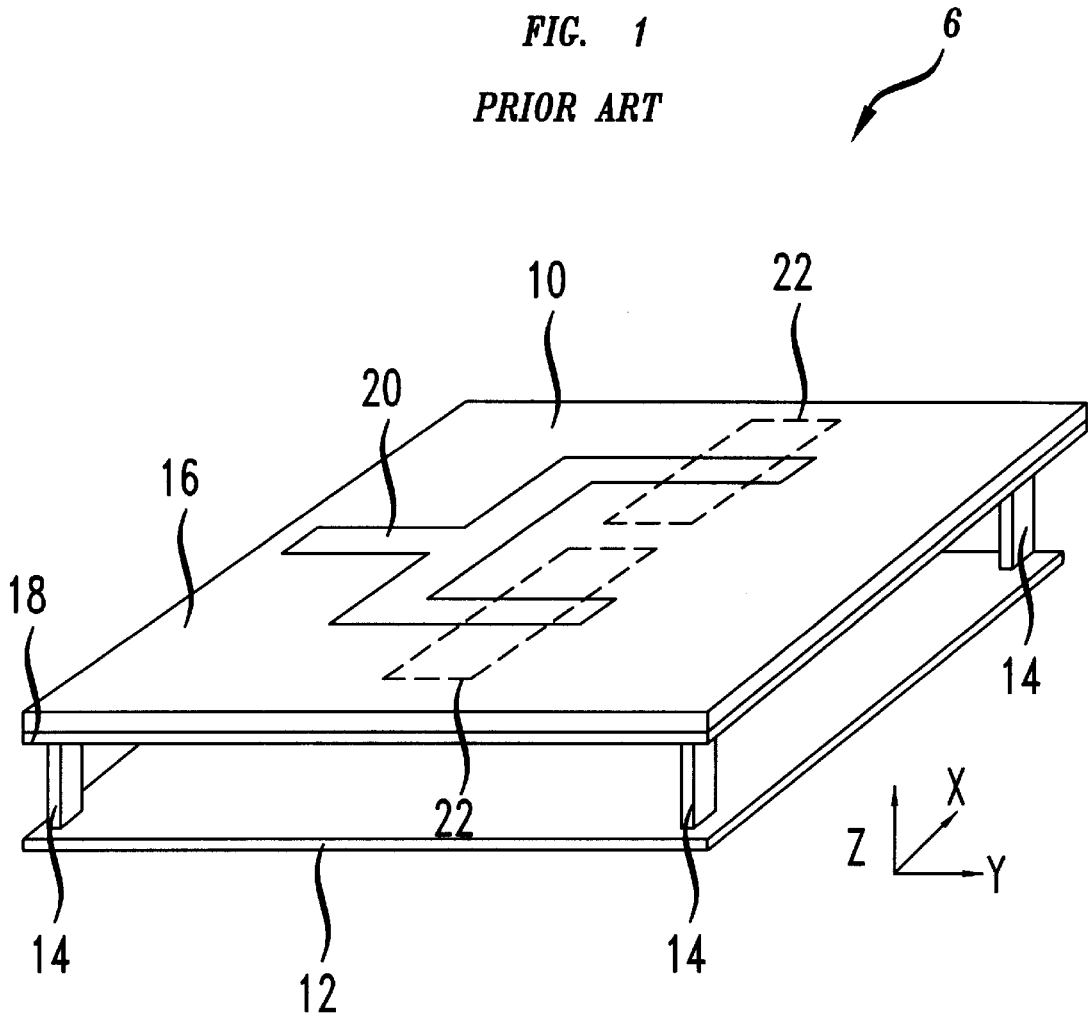
FIG. 1 PRIOR ART
FIG. 1 illustrates a prior art slot antenna assembly.
Figure 2:
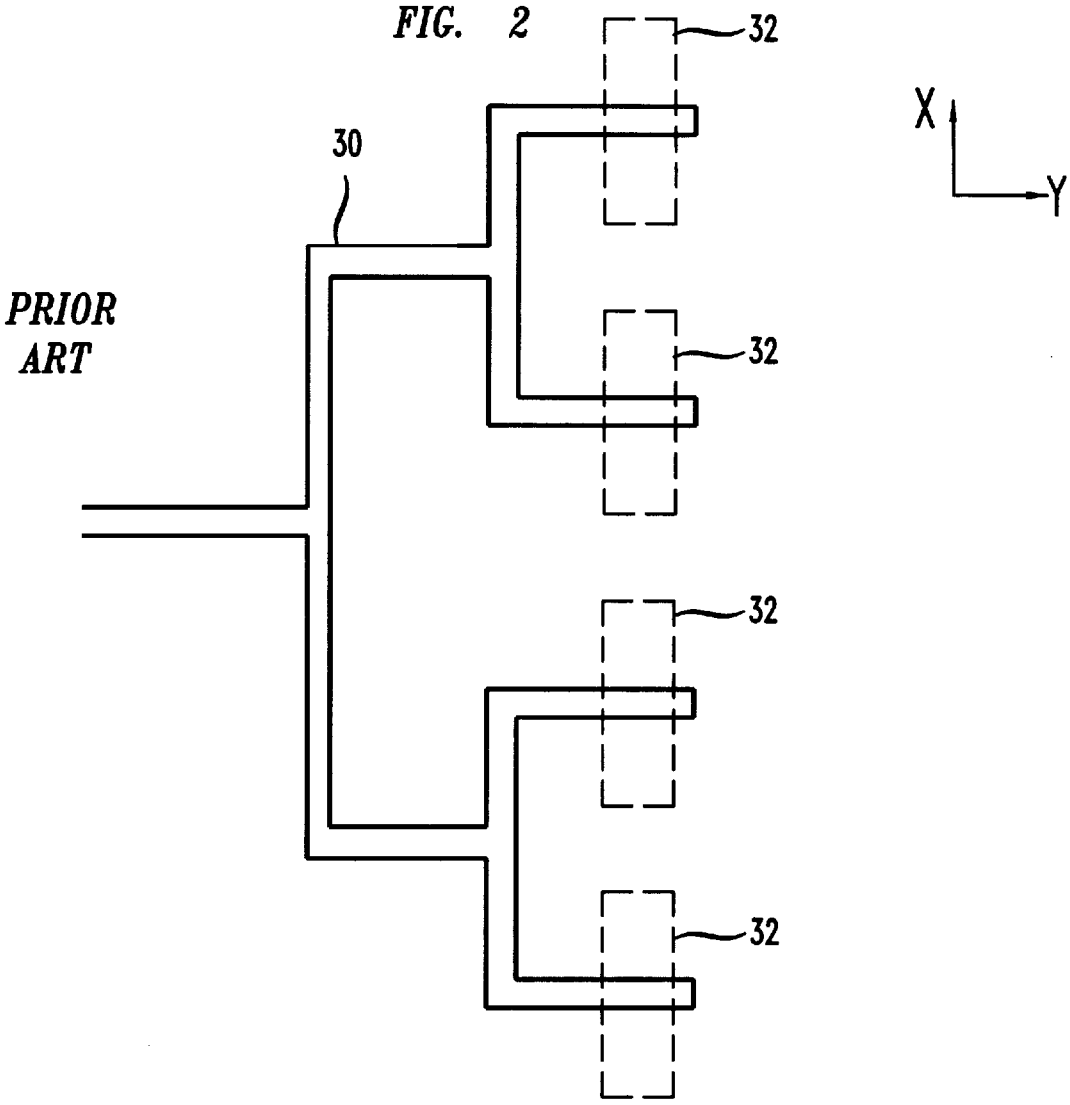
FIG. 2 illustrates a prior art slot array antenna having polarization in the Y direction.
Figure 4:
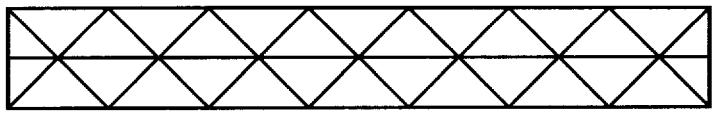
FIG. 4 illustrates a conductive mesh strip.
Figure 5:
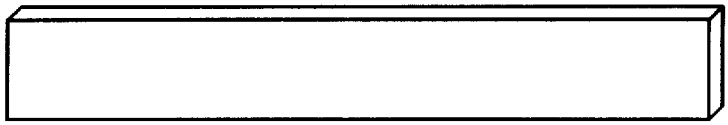
FIG. 5 illustrates a conductive solid strip.

The electric field barriers may be formed by a series of conductors such as wires that are spaced apart by approximately one-fifth or less of the transmitted/received signal's wavelength. Electric field barriers may be constructed using a series of wires, screws or other conductors. If the conductors have sufficient mechanical strength to hold front panel 110 and rear panel 112 in their relative positions, separate supports will not be required between front panel 110 and rear panel 112. It should be noted that electric field barriers 140, 142 or 144 may be formed using separate conductors 132 or a single continuous conductive strip. FIG. 4 illustrates a continuous conductive strip in the form of a mesh or fence, and FIG. 5 illustrates a continuous conductive strip in the form of a conductive wall or conductive tape. Electric field barriers 140, 142 or 144 may be formed using solid parts or parts with openings spaced closely so that an electric field barrier is formed for the frequency range over which the antenna will operate.

When a signal to be transmitted is provided on microstrip 118, an electric field polarized in the Y direction is emitted in the Z direction to form a transmit (or receive) beam in the Y-Z plane. Length 150 of slots 118 and 120 is approximately one-half of a wavelength of the signal to be transmitted and width 152 of slots of 118 and 120 is approximately one-eighth to one-tenth of a wavelength of the signal to be transmitted. The spacing between front panel 110 and rear panel 112 is approximately one-eighth to one-tenth of a wavelength. Distance 154 between the electric field barriers determines the resonant frequency of the antenna, where larger values of distance 154 produce lower resonant frequencies, and smaller values of distance 154 produce higher resonant frequencies. In either case, the resonant frequency should be chosen to correspond to the transmit or receive frequency of the antenna. Distance 156 between slots 118 and 120 determines the beamwidth of the transmitted energy. The beamwidth is a function of $\lambda/d$ where $\lambda$ corresponds to the wavelength of the transmit or receive frequency associated with the antenna, and d is distance 156. Large d's produce narrow beamwidths and small d's produce wide beamwidths.

Figure 6:
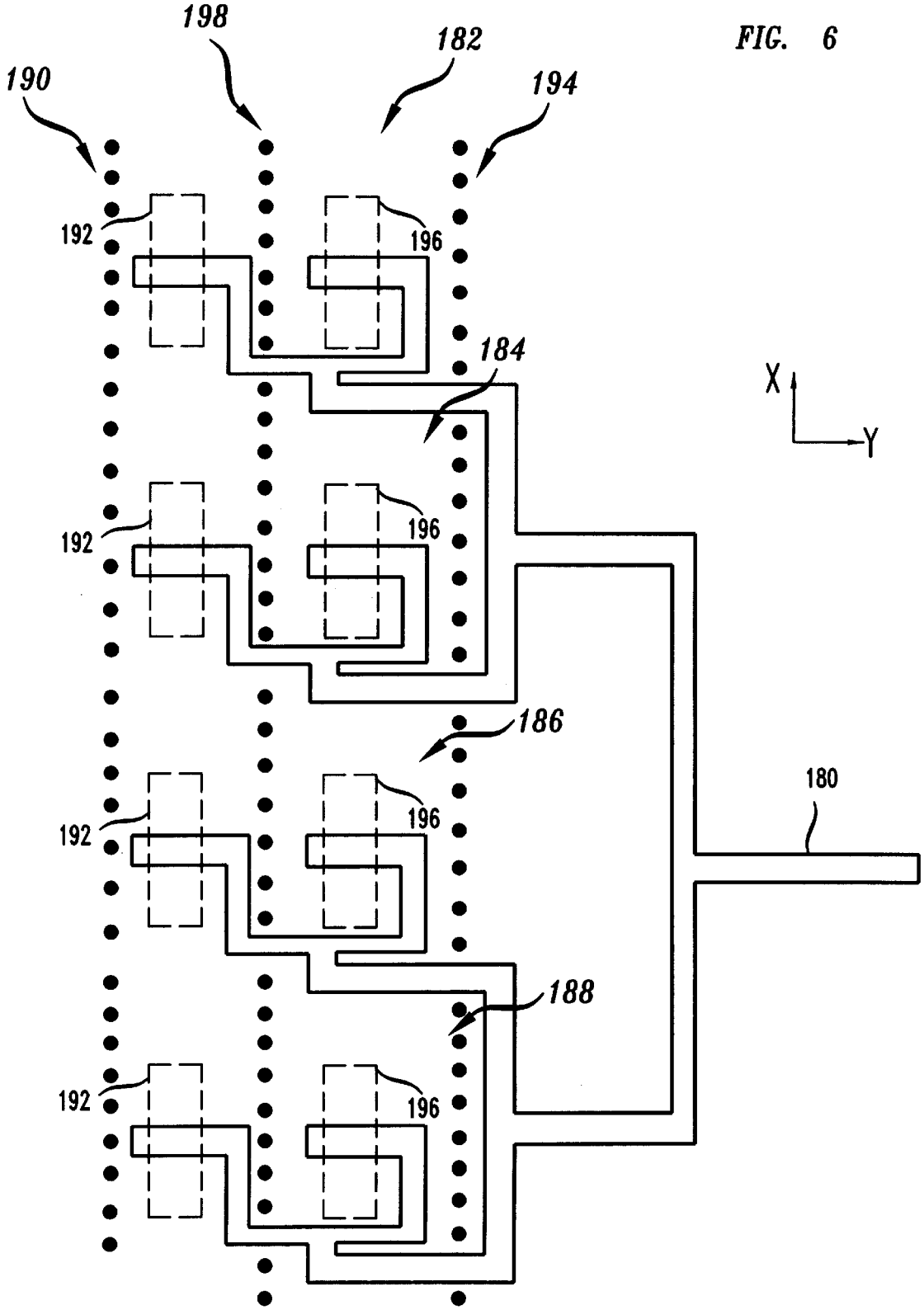
FIG. 6 illustrates a linear array of slot pairs with electric field barriers.

FIG. 6 illustrates a linear array of slot pairs having electric field barriers between and parallel to the slots. Microstrip

180 feeds the signal to be transmitted to slot pairs 182, 184, 186 and 188. The slot pairs have an electric field barrier 190 outside outer edges 192, and an electric field barrier 194 outside outer edges 196. Additionally, electric field barrier 198 separates the slots in each pair. The arrangement of FIG. 6 will result in a transmitted signal coming out of the figure toward the viewer (the Z direction) with an electric field polarized in the Y direction. The beamwidth in the Y-Z plane, as mentioned earlier, is controlled by the spacing between the slots of each slot pair. The spacing between the electric field barriers and the dimensions of each slot are based on the transmit or receive frequency associated with the antenna. It is possible to create arrays containing more than four pairs of slots or less than four pairs of slots. Additionally, it is also possible to arrange arrays with more than one column of slot pairs.

The invention claimed is:

1. An antenna, comprising:

a front panel having a conductive layer with at least a first slot and a second slot, and a signal conductor with at least a first and second conductive section, the signal conductor being separated from the conductive layer by a nonconductor, the first conductive section extending over the first slot and the second conductive section extending over the second slot;

a conductive rear panel substantially parallel to the front panel, the conductive rear panel being electrically connected to the conductive layer;

a first electric field barrier positioned between the first and second slots and extending between the front panel and the rear panel, the electric field barrier being in electrical contact with the front panel and the rear panel and being substantially parallel to a long slot edge;

a second electric field barrier positioned outside an outer edge of the first slot and extending between the front panel and the rear panel, the second electric field barrier being in electrical contact with the front panel and the rear panel and being substantially parallel to a long slot edge; and a third electric field barrier positioned outside an outer edge of the second slot and extending between the front panel and the rear panel, the third electric field barrier being in electrical contact with the front panel and the rear panel and being substantially parallel to a long slot edge.

2. The antenna of claim 1, wherein at least one of the first, second and third electric field barriers is a series of spaced conductors.

3. The antenna of claim 1, wherein at least one of the first, second and third electric field barriers is a continuous conductor.

4. The antenna of claim 3, wherein at least one of the first, second and third electric field barriers is a mesh strip.

5. The antenna of claim 3, wherein at least one of the first, second and third electric field barriers is a solid strip.

6. An antenna, comprising:

a front panel having a conductive layer with at least a first pair of slots, and a signal conductor with at least a first pair of conductive sections, the signal conductor being separated from the conductive layer by a nonconductor, the first pair of conductive sections having a first section extending over a first slot in the first pair of slots and a second section extending over a second slot in the first pair of slots;

a conductive rear panel substantially parallel to the front panel, the conductive rear panel being electrically connected to the conductive layer; and a first electric field barrier positioned between the first and second slots and extending between the front panel and the rear panel, the first electric field barrier being in electrical contact with the front panel and the rear panel and being substantially parallel to a long slot edge;

a second electric field barrier positioned outside an outer edge of the first slot and extending between the front panel and the rear panel, the second electric field barrier being in electrical contact with the front panel and the rear panel and being substantially parallel to a long slot edge; and a third electric field barrier positioned outside an outer edge of the second slot and extending between the front panel and the rear panel, the third electric field barrier being in electrical contact with the front panel and the rear panel and being substantially parallel to a long slot edge.

7. The antenna of claim 6, wherein at least one of the first, second and third electric field barriers is a series of spaced conductors.

8. The antenna of claim 6, wherein at least one of the first, second and third electric field barriers is a continuous conductor.

9. The antenna of claim 8, wherein at least one of the first, second and third electric field barriers is a mesh strip.

10. The antenna of claim 8, wherein at least one of the first, second and third electric field barriers is a solid strip.

* * * * *